US006564862B1

(12) United States Patent
Persson

(10) Patent No.: US 6,564,862 B1
(45) Date of Patent: May 20, 2003

(54) MULTICIRCUIT HEAT EXCHANGER

(75) Inventor: Lars Persson, Abbekås (SE)

(73) Assignee: EP Technology AB, Malmo (SE)

( * ) Notice: Subject to any disclaimer, the term of this patent is extended or adjusted under 35 U.S.C. 154(b) by 0 days.

(21) Appl. No.: 09/720,263

(22) PCT Filed: Jul. 7, 1999

(86) PCT No.: PCT/SE99/01235

§ 371 (c)(1),
(2), (4) Date: Feb. 28, 2001

(87) PCT Pub. No.: WO00/03189

PCT Pub. Date: Jan. 20, 2000

(30) Foreign Application Priority Data

Jul. 10, 1998 (SE) ..... 9802497

(51) Int. Cl.[7] ..... F28D 9/00
(52) U.S. Cl. ..... 165/140; 165/167
(58) Field of Search ..... 165/140, 167, 165/135

(56) References Cited

U.S. PATENT DOCUMENTS 3,513,907 A 5/1970 Hughes
5,462,113 A * 10/1995 Wand ..... 165/167
5,720,341 A * 2/1998 Watanabe et al. ..... 165/135

FOREIGN PATENT DOCUMENTS

DE 2430836 A1 * 1/1975 ..... 165/140
GB 660469 A1 * 11/1951 ..... 165/140
JP 56-993 A1 * 1/1981 ..... 165/140
RU 1121575 10/1984
WO WO 97/08506 3/1997

* cited by examiner

*Primary Examiner*—Allen Flanigan
(74) *Attorney, Agent, or Firm*—Oblon, Spivak, McClelland, Maier & Neustadt, P.C.

(57) ABSTRACT

The invention relates to a multicircuit heat exchanger, i.e. a heat exchanger capable of circulating more than two media. Through delimiting zones in the heat exchanger package, a further medium can be placed in heat exchange with one of the two media normally being circulated. Several such delimited zones may be arranged in the same heat exchanger package, and the zones may even overlap each other for mutual heat exchange. The present invention thus provides a multicircuit heat exchanger comprising plates (1) with a pattern of grooves and inlet and outlet connections. The plates are placed in a package and brazed together to form separate ducts for two main media between alternate pairs of plates. According to the invention, at least one delimited zone (8, 9, 10) is defined between alternate pairs of plates, to block off a first medium whereas a second medium is allowed to flow through. The delimited zone has inlets and outlets (3, 5, 7) for circulation of a further medium under heat exchange with the second medium.

7 Claims, 2 Drawing Sheets

MULTICIRCUIT HEAT EXCHANGER

FIELD OF THE INVENTION

The present invention relates to a multicircuit heat exchanger, i.e. a heat exchanger capable of circulating more than two media. Through delimiting zones in the heat exchanger package, a further medium can be placed in heat exchange with one of the two media normally being circulated. Several such delimited zones may be arranged in the same heat exchanger package, and the zones may even overlap each other for mutual heat exchange.

STATE OF THE ART

In today's conventional heat exchangers, two media are circulated in heat exchange with each other. There is, however, a requirement for circulating further media in the exchanger, e.g. for additional heating.

The present invention eliminates the above limitation of the prior art by providing delimited zones or islands in the heat exchanger. Inside these zones, a further medium may be circulated and be in heat exchange with one of the other media.

SUMMARY OF THE INVENTION

The present invention thus provides a multicircuit heat exchanger comprising plates with a pattern of grooves and inlet and outlet connections. The plates are placed in a package and brazed together to form separate ducts for two media between alternate pairs of plates.

According to the invention, at least one delimited zone is defined between alternate pairs of plates, to block off a first medium whereas a second medium is allowed to flow through. The delimited zone has an inlet and an outlet for circulation of a further medium under heat exchange with said second medium.

The invention is defined by the accompanying claim 1, whereas advantageous embodiments are stated in the dependent claims.

BRIEF DESCRIPTION OF THE DRAWINGS

The invention will be described in detail below, with reference to the accompanying drawings, of which.

DETAILED DESCRIPTION OF PREFERRED EMBODIMENTS

Plate type heat exchangers are generally known devices for heat exchange between two different media. Plate type heat exchangers are used in a multitude of contexts and the present invention is not limited to any special application. However, the invention is most easily applied to heat exchangers of the wholly brazed type. This means that the heat exchanger consists of plates having a groove pattern and inlet and outlet connections for two media. The plates are placed in a package and are brazed together into a fixed unit. Separate ducts are thus formed for the two media, circulating in opposite directions between alternate pairs of plates. This technique is commonly known and will not be described in detail here.

The normal situation is, then, that two media are circulating inside the heat exchanger. These media, for the purpose of this application, are called the main media. There is however, a requirement for circulating further media in the heat exchanger, e.g. for additional heating. According to the present invention, it is possible to arrange an arbitrary number of islands or delimited zones in the heat exchanger. Such an island is separated from one main medium but is in heat exchange with the other main medium. Different islands may be arranged for heat exchange with different main media. It is also possible to arrange an island lying entirely within another island. In the overlapping section, the further media are in heat exchange with each other whilst one of the further media is in heat exchange with one of the main media in the non-overlapping section.

Figure 1:
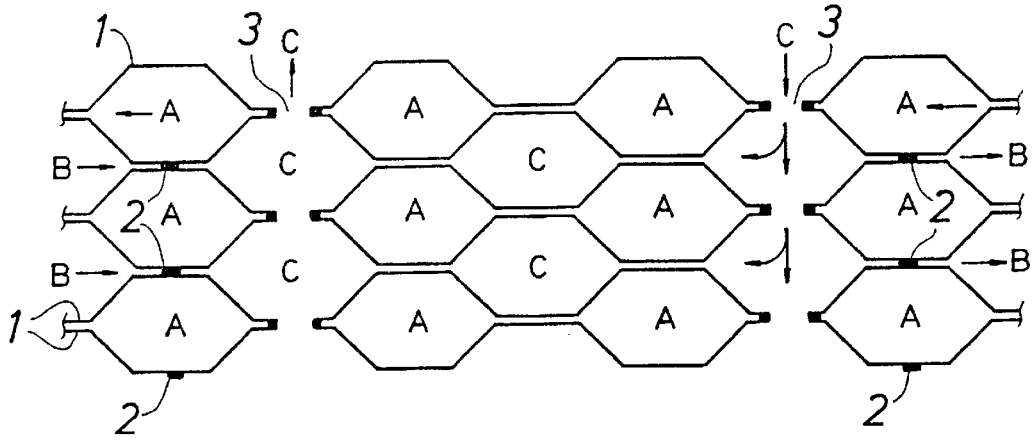
FIG. 1 is a schematic cross section view of a first embodiment of the invention.
Figure 3:
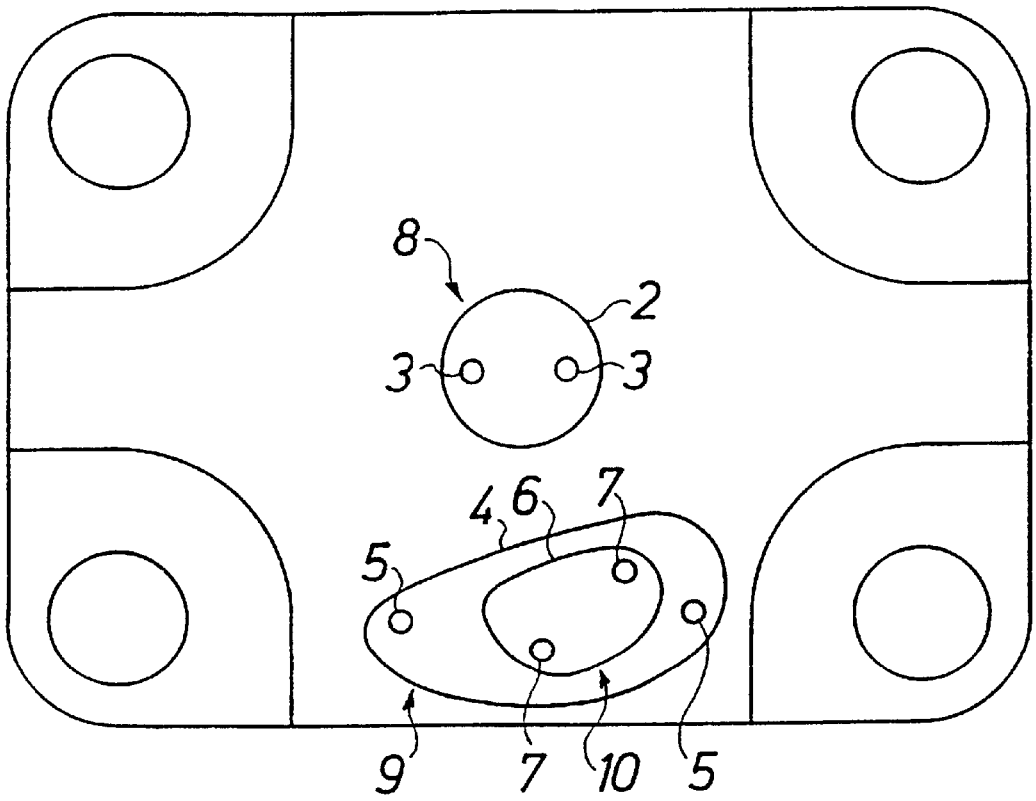
FIG. 3 is a top view of heat exchanger plates incorporating various embodiments of the invention.

FIG. 1 shows, schematically, a first embodiment of the invention. The heat exchanger plates are shown in cross section. In order to create the delimited zone or island, a barrier 2 is provided. In FIG. 1, the barrier is only shown as brazing points, but it consists of continuous grooves or recesses, and ridges, respectively, in each plate, as can be seen from FIG. 3, so as to create a closed delimitation. FIG. 1 also shows the inlet and the outlet 3. These consist of bores through all the plates, pairs of plates being brazed together. As is customary, the heat exchanger will have a bottom plate (not shown), sealing off the heat exchanger package in the downwards direction, and a top plate (not shown) having the normal connections for the main media. The island is designated 8 in FIG. 3. The connections may also be located on the bottom plate or on both the top plate and the bottom plate.

In FIG. 1, two main media A and B are shown, generally flowing to the left and to the right, respectively. As can be seen in the figure, the medium A will not be affected by the barrier 2, but can circulate through the island. The medium B, however, is separated from the island and can only circulate outside thereof. A further medium C circulates inside the island as shown by the arrows. The flow may of course also be made to run in the other direction. The further medium C also has its inlet and outlet connections through the top or the bottom plates (not shown). Within the delimited zone, or island, the medium C is thus in heat exchange with one of the main media, A. The delimited zone extends throughout the entire heat exchanger package, from the top plate to the bottom plate.

It will be understood, that the barrier 2 in FIG. 1 could just as well be located so as to place the delimited zone in heat exchange with the second main medium, B. It is possible to arrange several islands at different locations in the heat exchange package. The islands may be in heat exchange with the same main medium or with different main media, as required.

Figure 2:
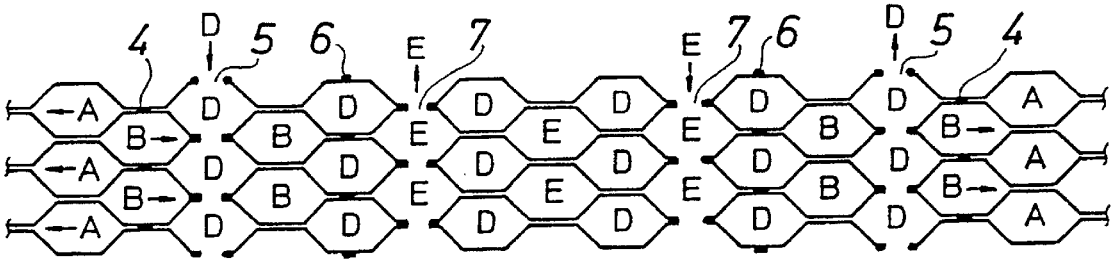
FIG. 2 is a schematic cross section view of a second embodiment of the invention.

FIG. 2 illustrates a further variation of the invention. Here, the heat exchanger comprises two islands that partly overlap each other. One island is arranged entirely within another island. The main media A and B are otherwise circulating in the same manner between the plates 1.

One island is defmed by an exterior barrier 4 in FIG. 2. This barrier has an inlet and an outlet designated 5. Inside this island, a further medium D circulates in an arbitrary direction. The island is designated 9 in FIG. 3.

In the centre of FIG. 2 there is a further, inner island, delimited by an interior barrier 6. This island has the respective inlet and outlet 7. In this island a further medium E circulates in an arbitrary direction. The island is designated 10 in FIG. 3.

To the left and to the right, where the outer island does not overlap the inner island, the main medium B (or the main medium A with an alternative location of the barriers 4 and 6) is in heat exchange with the further medium D. Where the two islands overlap each other, i.e. the entire inner island, the further media D and E are in heat exchange with each other. Outside the islands, the main media A and B are in heat exchange with each other as usual.

It is theoretically possible to place an arbitrary number of islands anywhere on the heat exchanger.

The present invention thus provides a novel heat exchanger of a multicircuit type that can handle more than two, and theoretically an arbitrary number of, media. Such a multicircuit heat exchanger has a vast application. For example, radiator heat and hot water can be accommodated in the same heat exchanger. Surplus heat can be conducted to an evaporator. In the process industry, it will be possible to handle several different media.

The person skilled in the art will understand that the shape and design of the heat exchanger, and the shapes of the islands, can be varied in many different ways within the spirit of the invention. The protective scope of the invention is solely limited by the following claims.

What is claimed is:

1. Multicircuit heat exchanger comprising plates, with a pattern of grooves and with inlet and outlet connections, placed in a package and brazed together to form separate ducts for two media, a first set of ducts being provided for allowing a first medium to flow between first pairs of plates, and a second set of ducts being provided for allowing a second medium to flow between alternate pairs of plates, further comprising at least one delimited zone being defined by a barrier within said package, said barrier blocking off areas inside said first set of ducts for said first medium, while not blocking off areas inside said second set of ducts for said second medium, said zone having an inlet and an outlet for circulation of a further medium through said areas within said delimited zone under heat exchange with said second medium.

2. Multicircuit heat exchanger according to claim 1, characterised by at least one further delimited zone being defined by a further barrier within said package, said further barrier blocking off areas inside said second set of ducts for the second medium, while not blocking off areas inside said first set of ducts for the first medium, said further delimited zone having an inlet and an outlet for circulation of still another further medium through said areas within said further delimited zone under heat exchange with said first medium.

3. Multicircuit heat exchanger according to claim 1, characterised by an inner delimited zone defined by a barrier being arranged within another, outer delimited zone defined by a barrier, such that the first medium is in heat exchange with a first further medium in a non-overlapping portion of the outer delimited zone, and that the first further medium and the second further medium are in heat exchange with each other in an overlapping portion of the two delimited zones.

4. Multicircuit heat exchanger according to claim 1, characterised by the respective barriers being created by recesses and ridges, respectively, in alternating pairs of plates, for defining closed, continuous barriers between every other pair of plates.

5. Multicircuit heat exchanger according to claim 2, characterised by an inner delimited zone defined by a barrier being arranged within another, outer delimited zone defined by a barrier, such that the first medium is in heat exchange with a first further medium in a non-overlapping portion of the outer delimited zone, and that the first further medium and the second further medium are in heat exchange with each other in an overlapping portion of the two delimited zones.

6. Multicircuit heat exchanger according to claim 2, characterized by the respective barriers being created by recesses and ridges, respectively, in alternating pairs of plates, for defining closed, continuous barriers between every other pair of plates.

7. Multicircuit heat exchanger according to claim 3, characterized by the respective barriers being created by recesses and ridges, respectively, in alternating pairs of plates, for defining closed, continuous barriers between every other pair of plates.

* * * * *